United States Patent [19]

Wong

[11] Patent Number: 4,554,683

[45] Date of Patent: Nov. 26, 1985

[54] PROTECTIVE ENCLOSURE HAVING SELF-CONTAINED AIR SUPPLY

[75] Inventor: Albert H. Wong, Los Angeles, Calif.

[73] Assignee: Wong Technology, Inc., Los Angeles, Calif.

[21] Appl. No.: 226,920

[22] Filed: Jan. 21, 1981

[51] Int. Cl.[4] ..... A42B 1/04

[52] U.S. Cl. ..... 2/202

[58] Field of Search ..... 2/4, 84, 88, 206, 205, 2/202, 410, 5, 417, 2, 1, 7; 98/115; 128/201.23, 201.29

[56] References Cited

U.S. PATENT DOCUMENTS

| | | | |
|---|---|---|---|
| 2,800,901 | 7/1957 | Monro | 2/202 |
| 3,562,813 | 2/1971 | Origer | 2/202 |
| 3,951,160 | 4/1976 | Nitu | 2/202 |
| 4,231,118 | 11/1980 | Nakagawa | 2/205 |
| 4,236,514 | 2/1980 | Moretti | 2/205 |
| 4,266,301 | 5/1981 | Canda | 2/410 |

*Primary Examiner*—Doris L. Troutman

*Attorney, Agent, or Firm*—Klein, Szekeres & Fischer

[57] ABSTRACT

A protective enclosure fabricated from a clear, flexible, plastic material that, in the event of an emergency, is easily positionable over the head and upper body of a wearer to protect the wearer from the adverse effects of a contaminated environment, such as that filled with smoke or similar noxious fumes. The top of the enclosure is sealed by a reinforced, relatively stiff closure member. Accordingly, an airspace containing a reserve air supply from which the wearer may breathe is created around the wearer's head. The bottom of the enclosure contains a fastener by which the enclosure may be securely tightened around the waist of the wearer. Each side of the enclosure includes an arm port through which the wearer's arms may extend. The arm ports are interfaced with an elastic material which is adapted to form an airtight seal around the wearer's arms when the arms are inserted therethrough. The protective enclosure may optionally have one or more filtering assemblies established therein through which the wearer may breathe in the event that the reserve air supply becomes exhausted. Hence, a relatively low cost, reliable, and easily operable protective enclosure is provided that can be folded and conveniently placed in a pouch for either storage or distribution, such as to the occupants of a high-rise building for use in the event of fire, or similar catastrophe.

8 Claims, 4 Drawing Figures

PROTECTIVE ENCLOSURE HAVING SELF-CONTAINED AIR SUPPLY

BACKGROUND OF THE INVENTION

1. Field of the Invention

This invention relates to a protective enclosure that is adapted to protect a wearer from the adverse effects of a contaminated environment, such as that which may contain smoke, toxic or noxious gases, and the like, by providing a self-contained supply of air from which the wearer may breathe in the event he is trapped within the contaminated environment.

2. Prior Art

Suffocation remains a major cause of death resulting from either of an airplane crash, a fire in a high-rise building, chemical fires, and the like. An individual may suffocate while being trapped within a contaminated environment, such as the scene of an accident, due to the inhalation of noxious gases, including smoke and various toxic fumes. By way of particular example, as an undesirable by-product of a fire, many plastic materials will generate toxic fumes when exposed to a flame. The fabrication of many components in the passenger compartment of an airplane or a subway car are capable of producing such undesirable toxic fumes in the event of a fire. What is more, individuals trapped during a fire within a high-rise building may find their welfare jeopardized as a result of relatively large amounts of smoke which tend to billow to the upper floors of the building. Hence, the occupants of high-rise buildings, airplanes and other sources of transportation could be threatened with loss of life in the even of their promixity to or involvement in any accident which would act to substantially reduce or contaminate the available supply of air.

Accordingly, many protective hoods and suits have been produced whereby to protect a wearer from the adverse effects of a contaminated environment, such at that containing smoke, and the like. Examples of conventional protective hoods and suits can be found by making reference to one or more of the following U.S. patents.

| U.S. Pat. No. | Issue Date |
|---|---|
| 1,140,025 | May 19, 1915 |
| 2,709,667 | May 31, 1955 |
| 3,458,864 | August, 1969 |
| 3,521,629 | July 28, 1970 |
| 3,562,813 | February 16, 1971 |
| 3,895,625 | July 22, 1975 |
| 4,231,118 | November 4, 1980 |

However, several shortcomings exist in the design and operation of the conventional protective hood and suit. Many of the conventional hoods and suits fit relatively snugly around the head and face of the wearer. Therefore, to enable the wearer of such a conventional garment to breathe, an auxiliary supply of air is required. In the past, this auxiliary supply of air was provided, for example, by a detachable mask, an air canister, a filtering means, or the like. Unfortunately, such air supply means are bulky and not always easily operated in an emergency situation. In addition, because of the flush fit made with the wearer's face, condensation often reduces visibility through a conventional protective enclosure within a relatively short amount of time. Moreover, the presence of the aforementioned auxiliary air supply does not readily permit the conventional protective hood or suit to be conveniently folded into a compact package for storage or distribution. What is even more, since conventional hoods are confined to the area of the wearer's head and conventional suits typically form a snug fit around the wearer's body, there is no way by which the wearer of a conventional protective garment can also protect a second individual, such as a small child or baby, within the same garment.

SUMMARY OF THE INVENTION

Accordingly, it is an important object of the present invention to provide a reliable protective envelope that is particularly fabricated to include a self-contained supply of air from which a wearer may breathe when said envelope is being worn in a contaminated (e.g. smoke filled) environment.

It is another object of the present invention to provide a protective envelope that is both relatively inexpensive to fabricate and flexible in construction, so as to permit said envelope to be conveniently folded into a compact package for either storage or distribution.

It is an additional object of the present invention to provide a protective envelope that extends from the head to at least the waist of the wearer in a manner that is suitable to prevent a contaminated environment from entering the envelope.

It is still another object of the present invention to provide a protective envelope in which a wearer may enclose both himself and a baby or small child.

It is yet another object of the present invention to provide a protective envelope that is fabricated from a strong, flexible material having a varying thickness, so that a relatively large airspace can be created above the wearer's head and an airtight seal can be made around the wearer's waist.

These and other objects and advantages of the invention will become apparent as the following description proceeds and the features of novelty which characterize this invention will be pointed out with particularity in the claims annexed to and forming part of this specification.

DESCRIPTION OF THE PREFERRED EMBODIMENT

Figure 1:
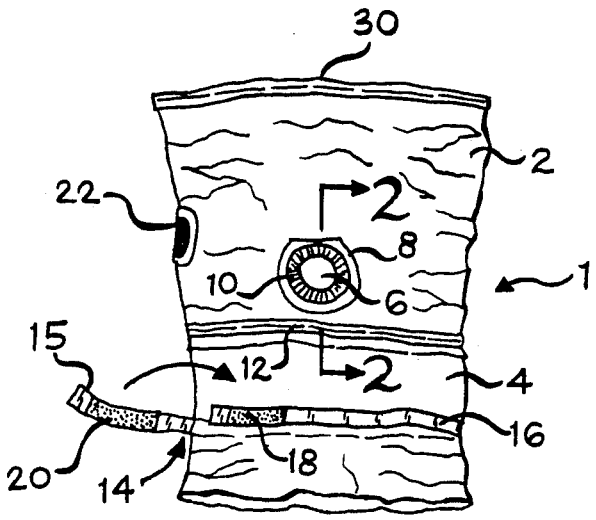
FIG. 1 is a side view showing the protective enclosure which forms the present invention.
Figure 2:
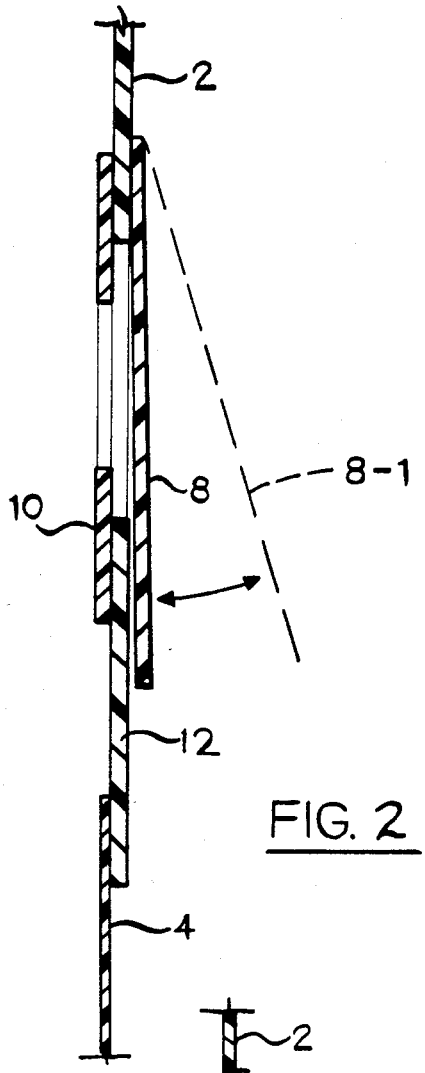
FIG. 2 is a cross-section taken along lines 2—2 of FIG. 1 showing the relative thicknesses of the hood and skirt portions which form the present protective enclosure.
Figure 3:
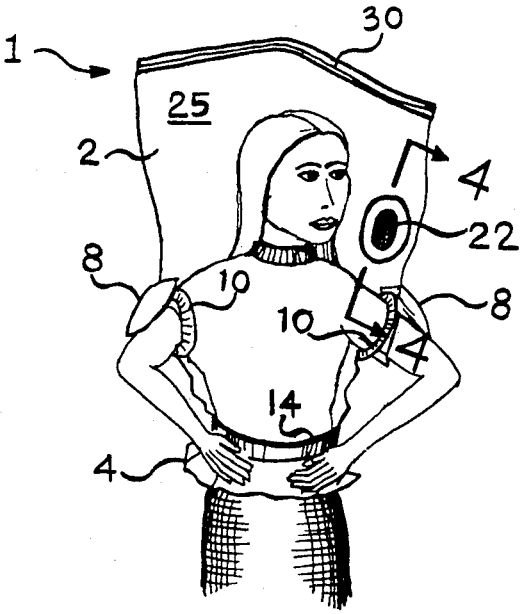
FIG. 3 is a front view of the present protective enclosure being worn and the airspace that is created around the head of the wearer.

The protective enclosure which forms the present invention is initially described while referring concurrently to FIGS. 1–3 of the drawings. The enclosure preferably comprises a bag 1 that is fabricated from a clear, flexible, heat resistant, plastic material, such as vinyl, or the like. Protective bag 1 comprises an upper hood portion 2 and a lower skirt portion 4. In a preferred embodiment of the invention, and as is best represented in FIG. 2, the walls of the hood portion 2 are thicker than the corresponding walls of the skirt portion 4. By way of particular example, the walls of hood portion 2 are approximately 6 mils thick, and the walls of the skirt portion 4 are approximately 3–4 mils thick. The advantages of fabricating protective bag 1 with hood and skirt portions 2 and 4 having different thicknesses will be described in greater detail hereinafter. The hood and skirt portions 2 and 4 are attached to one another along a seam 12 that is created by a suitable bonding technique, such as that comprising a heat sealing step. In the assembled relationship, the hood and skirt portions 2 and 4 of protective bag 1 are dimensioned so as to each extend for approximately one-half the overall length of bag 1.

The top edges of protective bag 1 are sealed together to form a relatively stiff, closure member 30. Closure member 30 extends along the entire width of protective bag 1, in order to form an airtight seal across the top thereof. By virtue of closure member 30, the top corners of bag 1 are generally square. Moreover, and as is best shown in FIG. 3, the square top corners are approximately preserved when bag 1 is worn, so as to maximize the size of an airspaced formed around the head of the wearer. The bottom of bag 1 is open ended, so as to be adapted for placement over the head and upper body of the wearer.

Located at opposite sides of protective bag 1 is a pair of arm ports 6. The arm ports are preferably located above the seam 12 that is created during the interconnection of the hood and skirt portions 2 and 4. Each arm port 6 comprises an aperture (e.g. such as an elongated slit or a rounded opening) that is established through the opposite sides of protective bag 1. Arm ports 6 are particularly sized in order to receive the arms of a wearer therethrough. A relatively thin piece of tape or paper material 8 is attached to the exterior surface of protective bag 1 so as to cover each arm port 6 with a flap. Material 8 is selected with a suitable thickness and is adapted to be easily broken or removed whenever the wearer of protective bag 1 thrusts his arms through arm ports 6. The position assumed by flap 8 when the wearer projects an arm through a respective arm port 6 is shown in phantom and represented by the reference numeral 8-1 in FIG. 2.

A well-known and readily avialable elastic material is attached to the interior surface of protective bag 1 around the aperture which defines each arm port 6. Therefore, the elastic material forms a short sleeve 10 that extends inwardly from each arm port 6. However, the diameter of each elastic sleeve 10 is made smaller than the diameter of the openings established through protective bag 1 to form respective arm ports 6. Therefore, the elastic sleeve 10 will be adapted to form a tight seal around the arm of a wearer whenever the wearer extends one or both of his arms through respective arm ports 6.

The skirt portion 4 of protective bag 1 is provided with a suitable fastening means by which bag 1 may be securely tightened around the waist of a wearer. By way of one particular example, the aforementioned fastening means comprise a belt 14. Belt 14 may include a pair of belt sections 15 and 16. Each belt section 15 and 16 may be integrally connected (i.e. bonded) to protective bag 1 around some or all of the periphery thereof. One belt section 16 is provided with a suitable interlocking means 18 connected thereto. By way of example, interlocking means 18 may be a material that is known in the art as VELCRO. The VELCRO material 18 covers a portion of the outwardly exposed surface of belt section 16. The other belt section 15 is provided with a complementary interlocking means 20. By way of the present example, interlocking means 20 also comprises VELCRO material. The Velcro material 20 covers the undesirable or downwardly exposed surface of a loosely hanging portion of belt section 15. The loosely hanging portion of belt section 15 can be pulled across the wearer's waist in a direction towards belt section 16, whereby to close the skirt portion 4 of bag 1 around the waist of the wearer. In this way, the respective VELCRO materials 20 and 18 of belt sections 15 and 16 can be aligned and mated to one another in conventional fashion, so that the skirt portion 4 will be securely attached to the wearer's waist while making an airtight seal therearound.

The utilization of the presently disclosed protective bag 1 by an individual trapped within a contaminated environment is best described while referring to FIGS. 1 and 3 of the drawings. In the event of a fire or other serious accident from which smoke or toxic fumes are generated, the protective bag 1 of the present invention forms a reliable means by which to protect the wearer against inhaling poisonous gases. In addition, the protective bag 1 provides the wearer with a reserve supply of air to give the wearer additional time by which to negotiate his rescue from the contaminated environment. Accordingly, a wearer who finds himself within a potentially contaminated environment merely slips the protective bag 1 over his head and upper body at the opened bottom end thereof. Because of the relative symmetry that is characteristic of protective bag 1, bag 1 may be positioned in any convenient alignment with the wearer's body, so long as the arm ports 6 are positioned to receive the wearer's arms therethrough. However, should protective bag 1 include a belt 14, such as that having interlocking belt sections 15 and 16, then bag 1 should be positioned over the wearer's head so that the belt 14 is located at the front of the wearer. Accordingly, with the bag 1 positioned over the wearer's upper body, the wearer projects each arm through a passage comprising elastic sleeve 10, arm port 6, and the covering material or flap (designated 8 in FIG. 2). The wearer is then free to tighten the skirt portion 4 around his waist by drawing belt section 15 towards belt section 16 and interlocking the mating (e.g. VELCRO) portions thereof. By varying the distance through which belt section 15 is drawn towards belt section 14, the skirt portion 4 can be securely tightened around a waist of practically any dimension.

The combination of covering flap material 8 and elastic sleeve 10 with arm port 6 provides an important aspect of the present invention. In a first case, in the event that both of the wearer's arms are extended through respective arm ports 6, the elastic sleeve 10 at the interior surface of protective bag 1 provides a seal by which to prevent noxious gases from communicating with the interior of bag 1 via arm ports 6. In a second case, it may be desirable that both a baby or small child and the wearer be concurrently afforded the protection of bag 1. More particularly, one of the arms of the wearer can be extended through a corresponding arm port 6, so as to permit the wearer to fasten belt 14 around his waist. However, the second arm of the wearer may remain within the enclosure of protective bag 1 in order that the wearer may clutch the baby or small child against his body. In this case, the flap material 8 which covers each arm port 6 at the exterior surface of protective bag 1 prevents noxious gases with communicating with the interior of bag 1 via an arm port 6. Hence, covering material 8 and elastic sleeve 10 act to prohibit the entry of smoke and noxious gases into bag 1 in the event that the arms of the wearer are either extended through or retained within the enclosure of protective bag 1.

As was previously disclosed, the top edges of protective bag 1 are sealed together, so as to form a relatively stiff closure member 30. Therefore, and unlike prior art protective bags which collapse substantially around the wearer's head, the present protective bag 1 is adapted to provide a self-contained and temporary air supply from which the wearer may breathe. More particularly, the square corners formed at the top of protective bag 1 (which corners are formed by virtue of the closure member 30) are generally preserved during use, so as to maximize the size of an airspace 25 that is formed around the head of the wearer. Thus, a relatively large air space 25 is created around the head of the wearer, in which a reserve supply of breathing air becomes available. The actual size of the airspace 25 will vary, depending upon the sizes of the protective bag 1 and the wearer. However, and by way of particular example, it has been found that a protective bag 1, formed in accordance with the present invention and having a height of approximately four feet is sufficient to provide approximately a 15 to 20 minute reserve supply of air for a wearer who is approximately five to six feet tall.

Accordingly, the protective bag 1 of the present invention is adapted to provide a potentially life saving supply of air from which the wearer may breathe without the necessity of masks, air canisters, or the like, as has heretofore been utilized with protective enclosures of the prior art. By virtue of the present protective bag 1, the wearer thereof may now have ample time in which to either await his rescue or to remove himself from a contaminated environment. The protective enclosure is fabricated from a relatively thick hood portion 2 and a thinner skirt portion 4. Accordingly, the hood portion 2 is provided with increases rigidity for maximizing the size of the airspace 25, while the flexibility of skirt portion 4 is maximized to enhance the ability by which skirt portion 4 can be secured around the waist of the wearer.

Figure 4:
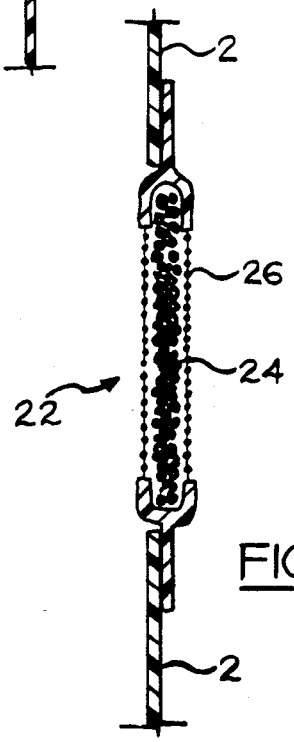
FIG. 4 is a cross-section taken along lines 4—4 of FIG. 3 detailing the optional filter arrangement that may be established within the present protective enclosure.

As an alternate embodiment of the present invention, one or more conventional filtering means 22 may be installed within the hood portion 2 of protective bag 1. As is best shown in FIG. 4 of the drawings, filter 22 comprises a compartment that contains a well-known filtering material 24 for removing smoke particles and other relatively large contaminants. The filtering material 24 is typically surrounded by a gauze or light fabric material 26. Filter 22 can be used should the wearer of protective bag 1 find it necessary to breathe additional air in the event that the reserve supply of air contained within airspace 25 becomes substantially exhausted. Moreover, the outside of the filter 22 can be covered by a removable flap (not shown), so that the wearer of protective bag 1 may be totally isolated from the contaminated environment.

As will be appreciated by those skilled in the art, the presently disclosed protective bag 1 may be relatively easily manufactured at a relatively low cost. Moreover, by virtue of the flexible nature thereof, protective bag 1 may be folded into a compact configuration whereby to be placed in a storage container or package. In this way, a plurality of said protectable bags 1 may be conveniently stored or distributed so as to be made available for use by occupants of high-rise buildings, transportational sources, and the like. The present protective bag 1 is particularly advantageous because of the relative ease by which it may be worn. Moreover, and unlike any known prior art protective enclosure, a baby or small child may also be protected within the enclosure of bag 1.

It will be apparent that while a preferred embodiment of the present invention has been shown and described, various modifications and changes may be made without departing from the true spirit and scope of the invention. By way of example, the belt 14 is disclosed as one preferred means by which to secure the skirt portion 4 of protective bag 1 to the wearer's waist. However, it is to be understood that other securing means may be substituted for belt 14. By way of an additional example, belt 14 may be replaced by an elastic band integrally formed with the skirt portion 4. The skirt portion 4 of bag 1 can thereby be self-sealing around the waist of the wearer. Yet an additional example is to replace belt 14 with either of a pair of drawstrings or the combination of a single drawstring and a latching assembly. In the first case, the drawstrings are tied around the waist of the wearer and, in the second case, a drawstring may be locked within a complementary tab or buckle, whereby to tightly secure the skirt portion 4 of protective bag 1 around the waist of the wearer.

Having thus set forth a preferred embodiment of the present invention, what is claimed is:

1. A flexible protective enclosure to protect a wearer from suffocation due to the presence of smoke and similar noxious fumes within a contaminated environment, said enclosure being closed at the top end thereof and being opened at the bottom end thereof so that said enclosure can be positioned over the head of the wearer, said enclosure top end being closed by a relatively rigid closure member comprising a seal by which the top edges of said enclosure are connected together, said seal extending across said enclosure top end, so that the corners thereof are substantially square for separating said top end from the head of the wearer, said enclosure including a pair of arm ports established therethrough and elastic sleeves aligned with respective arm ports at the interior of said enclosure for receiving the arms of the wearer therepast and for making an airtight seal therearound, said enclosure extending from above the head to the trunk at a location below the shoulders of the wearer and having fastening means by which to secure said enclosure to the wearer, such that said enclosure is spaced away from the wearer's head and trunk, so as to produce an airspace therearound in which a temporary supply of air is contained, said enclosure operating to prevent fluid communication between the contaminated environment and said airspace so that the wearer may breathe from said airspace while within the contaminated environment.

2. The protective enclosure recited in claim 1, further including a flap positioned over and covering a respective arm port at the exterior of said enclosure for preventing the contaminated environment from entering the enclosure through said arm port.

3. The protective enclosure recited in claim 1, wherein said enclosure comprises a hood portion and a skirt portion, said hook portion receiving therein the head of the wearer and being spaced from the head to form said airspace therearound, and said skirt portion extending to and being spaced from the trunk of the wearer at a location below the arms to form therearound a continuation of said airspace, said skirt portion being secured to the wearer's body by said fastening means.

4. The protective enclosure recited in claim 3, wherein said hood portion is fabricated from a material that is thicker than the material from which said skirt portion is fabricated.

5. The protective enclosure recited in claim 1, wherein said fastening means comprises a belt having first and second belt sections, said first and second belt sections being releasably interconnected to one another, whereby to secure said enclosure around the body of the wearer.

6. The protective enclosure recited in claim 5, wherein each of said belt sections includes VELCRO material, whereby said sections may be releasably interconnected to one another.

7. The protective enclosure recited in claim 1, including at least one filter means established in said enclosure through which the user may breathe.

8. A clear, flexible protective envelope to be worn over the body of a wearer while within a contaminated environment, such as that containing smoke, or the like, said envelope comprising:

arms ports established in said envelope, so that the arms of the wearer can be extended therethrough, elastic sleeves aligned with respective arm ports for receiving the arms of the wearer therethrough and for making an air-tight seal therearound, means positioned over and covering respective arm ports for preventing the contaminated environment from entering the envelope through said arm ports, fastening means by which to secure said envelope to the body of the wearer and for making an air-tight seal therearound, and means by which to shape said envelope so as to provide an air space around the head of the wearer, in which air space a temporary supply of air is contained and from which the wearer may breathe while within the contaminated environment.

* * * * *